US006940219B2

(12) United States Patent
Russ et al.

(10) Patent No.: US 6,940,219 B2
(45) **Date of Patent: *Sep. 6, 2005**

(54) FIELD EMISSION DISPLAY UTILIZING A CATHODE FRAME-TYPE GATE

(75) Inventors: Benjamin Edward Russ, San Diego, CA (US); Jack Barger, San Diego, CA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/702,202

(22) Filed: Nov. 4, 2003

(65) Prior Publication Data

US 2004/0090163 A1 May 13, 2004

Related U.S. Application Data

(62) Division of application No. 09/877,443, filed on Jun. 8, 2001, now Pat. No. 6,756,730.

(51) Int. Cl.[7] ..... H01J 1/62
(52) U.S. Cl. ..... 313/495; 313/310; 313/292
(58) Field of Search ..... 313/495–497, 313/309–311, 336, 351, 292, 293

(56) References Cited

U.S. PATENT DOCUMENTS

| | | | |
|---|---|---|---|
| 3,665,241 | A | 5/1972 | Spindt |
| 4,591,758 | A | 5/1986 | Barth et al. |
| 4,857,161 | A | 8/1989 | Borel |
| 4,940,916 | A | 7/1990 | Borel |
| 5,019,003 | A | 5/1991 | Chasen |
| 5,053,673 | A | 10/1991 | Tomii et al. |
| 5,063,327 | A | 11/1991 | Brodie |
| 5,070,282 | A | 12/1991 | Epsztein |
| 5,216,324 | A | 6/1993 | Curtin |
| 5,245,247 | A | 9/1993 | Hosogi |
| 5,311,360 | A | 5/1994 | Bloom et al. |
| 5,340,997 | A | 8/1994 | Kuo |
| 5,448,133 | A | 9/1995 | Ise |
| 5,473,222 | A | 12/1995 | Thoeny et al. |
| 5,508,584 | A | 4/1996 | Tsai et al. |

(Continued)

OTHER PUBLICATIONS

PCT/US03/11818. OCT. 9, 2003. International Search Report. Sony Electronics, Inc.
PCT/US03/11410. Apr. 5, 2004. International Search Report. Sony Electronics, Inc.

(Continued)

*Primary Examiner*—Ashok Patel
(74) *Attorney, Agent, or Firm*—Thomas F. Lebens; Fitch, Even, Tabin & Flannery

(57) ABSTRACT

Structures for field emission displays and methods of making and using such structures are provided. In one implementation, a cathode plate of a field emission display includes a cathode substrate of the field emission display and a plurality of emitter lines formed on the cathode substrate. In another implementation, an anode plate of a field emission display includes a transparent piece of the field emission display and a plurality of phosphor lines formed on the transparent piece. The plurality of phosphor lines are to be aligned with and receive electrons from a plurality of emitter lines of a cathode substrate of the field emission display.

14 Claims, 13 Drawing Sheets

U.S. PATENT DOCUMENTS 5,528,103 A 6/1996 Spindt et al.
5,548,185 A 8/1996 Kumar et al.
5,556,316 A 9/1996 Taylor
5,561,345 A * 10/1996 Kuo ..... 313/495
5,565,742 A 10/1996 Schichao
5,587,628 A 12/1996 Kuo
5,614,785 A 3/1997 Wallace
5,619,097 A 4/1997 Jones
5,649,847 A 7/1997 Haven
5,688,708 A 11/1997 Kato et al.
5,689,151 A 11/1997 Wallace
5,717,287 A 2/1998 Amrine
5,773,921 A 6/1998 Keesmann et al.
5,789,848 A 8/1998 Dworsky et al.
5,811,926 A 9/1998 Novich
5,827,102 A 10/1998 Watkins et al.
5,834,891 A 11/1998 Novich
5,838,103 A 11/1998 Park
5,880,554 A 3/1999 Liu
5,910,704 A 6/1999 Choo
5,949,394 A 9/1999 Kishino
5,962,959 A 10/1999 Iwasaki
5,977,703 A * 11/1999 Ju et al. ..... 313/495
5,986,390 A 11/1999 Chuman
5,986,625 A 11/1999 Huang
6,004,912 A 12/1999 Gudeman
6,027,388 A 2/2000 Jones et al.
6,031,328 A 2/2000 Nakamoto
6,039,622 A 3/2000 Kosaka et al.
6,064,148 A 5/2000 Tolt
6,066,922 A 5/2000 Iwasaki
6,094,001 A 7/2000 Xie
6,097,138 A 8/2000 Nakamoto
6,136,621 A 10/2000 Jones et al.
6,144,144 A 11/2000 Cleeves et al.
6,146,230 A 11/2000 Kim et al.
6,149,484 A 11/2000 Amrine et al.
6,153,969 A 11/2000 Levine
6,172,456 B1 1/2001 Cathey et al.
6,175,346 B1 1/2001 Chiu et al.
6,194,333 B1 2/2001 Ryu
6,323,831 B1 11/2001 Ono et al.
6,335,728 B1 1/2002 Kida et al.
6,354,898 B2 3/2002 Kim
6,359,383 B1 3/2002 Chuang et al.
6,377,002 B1 4/2002 Ge et al.
6,486,597 B1 11/2002 Goel et al.
6,489,710 B1 12/2002 Okita
6,509,677 B2 1/2003 Xia et al.
6,515,429 B2 2/2003 Russ et al.
6,559,602 B2 5/2003 Russ et al.
6,583,549 B2 6/2003 Takenaka
6,590,320 B1 7/2003 Abanshin et al.
6,624,590 B2 9/2003 Russ et al.
6,650,061 B1 11/2003 Urayama
6,663,454 B2 12/2003 Russ et al.
6,670,747 B2 12/2003 Ito
6,682,382 B2 1/2004 Russ et al.
6,747,416 B2 6/2004 Barger et al.
6,756,730 B2 6/2004 Russ et al.
6,774,548 B2 8/2004 Fran et al.
6,791,278 B2 9/2004 Russ
6,798,143 B2 9/2004 Frayssinet
2001/0035712 A1 11/2001 Berman et al.
2002/0047559 A1 4/2002 Frayssinet
2002/0185950 A1 12/2002 Russ et al.
2002/0185951 A1 12/2002 Russ et al.
2002/0185964 A1 12/2002 Russ et al.
2003/0052873 A1 3/2003 Ueda
2003/0193296 A1 10/2003 Russ et al.
2003/0193297 A1 10/2003 Russ et al.
2003/0201721 A1 10/2003 Veillette
2004/0007988 A1 1/2004 Barger et al.
2004/0090163 A1 5/2004 Barger et al.
2004/0100184 A1 5/2004 Russ et al.
2004/0104667 A1 6/2004 Russ et al.
2004/0145299 A1 7/2004 Wang et al.
2004/0189552 A1 9/2004 Russ et al.
2004/0189554 A1 9/2004 Russ et al.

OTHER PUBLICATIONS

Bloom, "The Grating Light Valve: revolutionizing display technology" pp 1–21. Oct. 1, 2002. http://www.siliconlight.com/webpdf/pw97.pdf.

Gudeman, "Diffractive Optical MEMs Using Grating Light Value Technique," *EE Times. Mar. 18, 2002. pp 1–4. www.eetimes*.com/in_focus/communications/ OEG20020315S0047.

Ito, "Carbon–Nanotube–Based Triode–Field–Emission Displays Using Gated Emitter Structure," *IEEE Electron Device Letters*, Sep. 2001. pp 426–428. vol. 22, No. 9.

Beer, "The Sony Trinitron Tube," *Television.* Apr. 1989. pp 406–408. vol. 39 No. 6.

Yamada, "A New High–Resolution Trinitron Color Picture Tube for Display Application," *IEEE: Transactions on Consumer Electronics.* Aug. 1980. pp 466–473 vol. CE–26 No. 3.

Candescent Technologies, *Thin CRT Showcase*, http://www.candescent.com/Candescent/showcase.htm, Jan. 16, 2001, pp 1–4. Candescent Technologies Corporations.

Candescent Technologies, *ThinCRT Technology*, http://www.candescent.com/Candescent/tcrttch.htm, Jan. 16, 2001, pp 1–3. Candescent Technologies Corporation.

Candescent Technologies, *ThinCRT Concept*, http://www.candescent.com/Candescent/tcrtcnpt.htm, Jan. 16, 2001, pp 1–6. Candescent Technologies Corporation.

Candescent Technologies, *Candescent ThinCRT Technology Primer*,, http://www.candescent.com/Candescent/techprim.htm, Jan. 16, 2001, pp 1–5. Candescent Technologies Corporation.

* cited by examiner

FIELD EMISSION DISPLAY UTILIZING A CATHODE FRAME-TYPE GATE

This application is a divisional of U.S. patent application Ser. No. 09/877,443, filed Jun. 8, 2001 now U.S. Pat. No. 6,756,730, which is incorporated herein by reference.

This patent document relates to field emission display (FED) devices described in the following patent documents. The related patent documents, all of which are incorporated herein by reference, are:

U.S. patent application Ser. No. 09/877,365, of Russ, et al.; filed Jun. 8, 2001; entitled METHOD OF VARIABLE RESOLUTION ON A FLAT PANEL DISPLAY, now U.S. Pat. No. 6,515,429;

U.S. patent application Ser. No. 09/877,512, of Russ, et al.; filed Jun. 8, 2001; entitled METHOD FOR CONTROLLING THE ELECTRIC FIELD AT A FED CATHODE SUB-PIXEL; now U.S. Pat. No. 6,559,602;

U.S. patent application Ser. No. 09/877,379, of Russ, et al.; filed Jun. 8, 2001; entitled METHOD FOR MAKING WIRES WITH A SPECIFIC CROSS SECTION FOR A FIELD EMISSION DISPLAY;

U.S. patent application Ser. No. 09/877,496, of Russ, et al.; filed Jun. 8, 2001; entitled METHOD FOR ALIGNING FIELD EMISSION DISPLAY COMPONENTS;

U.S. patent application Ser. No. 09/877,371, of Russ, et al.; filed Jun. 8, 2001; entitled CARBON CATHODE OF A FIELD EMISSION DISPLAY WITH IN-LAID ISOLATION BARRIER AND SUPPORT;

U.S. patent application Ser. No. 09/877,510, of Russ, et al.; filed Jun. 8, 2001; entitled METHOD FOR DRIVING A FIELD EMISSION DISPLAY; and U.S. patent application Ser. No. 09/877,509, of Russ, et al.; filed Jun. 8, 2001; entitled CARBON CATHODE OF A FIELD EMISSION DISPLAY WITH INTEGRATED ISOLATION BARRIER AND SUPPORT ON SUBSTRATE.

BACKGROUND OF THE INVENTION

1. Field of the Invention

The present invention relates generally to flat panel displays (FPDs), and more specifically to field emission displays (FEDs). Even more specifically, the present invention relates to the structural design of field emission displays (FEDs).

2. Discussion of the Related Art

A field emission display (FED) is a low power, flat cathode ray tube type display that uses a matrix-addressed cold cathode to produce light from a screen coated with phosphor materials. FIG. 1 is a side cut-away view of a conventional FED. The FED 100 includes a cathode plate 102 and an anode plate 104, which opposes the cathode plate 102. The cathode plate 102 includes a cathode substrate 106, a first dielectric layer 108 disposed on the cathode substrate 106 and several emitter wells 110. Within each emitter well 110 is an electron emitter 112. Thus, the electron emitters are formed as conical electron emitters, the shape of which aids in the removal of electrons from the tips of the electron emitters 112. Each electron emitter 112 is generally referred to as a cathode sub-pixel. The cathode plate 102 also includes a gate electrode 114 integral with the cathode substrate 106 and disposed on the first dielectric layer 108 and circumscribing each emitter well 110. In order to precisely align the gate electrode 114 with the electron emitters 112, the emitter wells 110 are formed by cutting them out of the first dielectric layer 108 and the gate electrode 114 as formed on the cathode substrate 106 and then placing the electron emitters 112 within the emitter wells 110. As such, the manufacture of the cathode plate 102 is difficult and expensive.

The anode plate 104 includes a transparent substrate 116 upon which is formed an anode 118. Various phosphors are formed on the anode 118 and oppose the respective electron emitters 112, for example, a red phosphor 120, a green phosphor 122 and a blue phosphor 124, each phosphor generally referred to as an anode sub-pixel.

The FED 100 operates by selectively applying a voltage potential between cathodes of the cathode substrate 106 and the gate electrode 114, which causes selective emission from electron emitters 112. The emitted electrons are accelerated toward and illuminate respective phosphors of the anode 118 by applying a proper potential to a portion of the anode 118 containing the selected phosphor. It is noted that one or more electron emitters may emit electrons at a single phosphor.

Additionally, in order to allow free flow of electrons from the cathode plate 102 to the phosphors and to prevent chemical contamination (e.g., oxidation of the electron emitters), the cathode plate 102 and the anode plate 104 are sealed within a vacuum. As such, depending upon the dimensions of the FED, e.g., structurally rigid spacers (not shown) are positioned between the cathode plate 102 and the anode plate 104 in order to withstand the vacuum pressure over the area of the FED device.

In another conventional FED design illustrated in FIG. 2, an FED 200 further includes a second dielectric layer 202 disposed upon the gate electrode 114 and a focusing electrode 204 disposed upon the second dielectric layer 202. In operation, a potential is also applied to the focusing electrode 204. This potential is selected to collimate the electron beam emitted from respective electron emitters 112. Thus, the focusing electrode 204 concentrates the electrons to better illuminate a single phosphor, i.e., the emitted electrons are focused. However, in order to reduce the spread of electrons, a separate focusing structure (i.e., focusing electrode 204) formed over the gate electrode 114 and that is integral to the cathode substrate 106 is required.

FIG. 3 illustrates a cut-away perspective view of the conventional FED 100 of FIG. 1. As shown, the gate electrode 114 and the first dielectric layer 108 form a grid in which the generally circular-shaped emitter wells 110 are formed. In fabrication, the first dielectric layer 108 and the gate electrode 114 are formed over the cathode substrate 106. The emitter wells 110 are formed by etching or cutting out the first dielectric layer 108 and the gate electrode 114. The conical-shaped electron emitters 112 are then deposited into the emitter well 110.

Advantageously, the conventional FED provides a relatively thin display device that can achieve CRT-like performance. However, the conventional FED is limited by the pixelation of the device. For example, since there are a fixed number of electron emitters 112 and phosphors aligned therewith, the resolution of the conventional FED is fixed. Furthermore, the manufacture of conventional FEDs has proven difficult and expensive. Additionally, while driving the conventional FED, i.e., applying the proper potential between the gate electrode and the electron emitters 112, cross-talk is a common problem.

SUMMARY OF THE INVENTION

The present invention advantageously addresses the needs above as well as other needs by providing an improved field emission display (FED) having a novel structural design.

In one embodiment, the invention can be characterized as a cathode plate of a field emission display including a cathode substrate of the field emission display and a plurality of emitter lines formed on the cathode substrate.

In another embodiment, the invention may be characterized as an anode plate of a field emission display including a transparent piece of the field emission display and a plurality of phosphor lines formed on the transparent piece. The plurality of phosphor lines are to be aligned with and receive electrons from a plurality of emitter lines of a cathode substrate of the field emission display.

In yet another embodiment, the invention may be characterized as a method of providing a field emission display comprising the steps of: providing a cathode substrate including a plurality of emitter lines formed on the cathode substrate; providing a gate frame positioned over the cathode substrate, the gate frame including a plurality of gate wires; and providing an anode plate including a plurality of phosphor lines positioned over the gate frame, the plurality of phosphor lines aligned with the plurality of emitter lines.

In another embodiment, the invention may be characterized as a method of making a field emission display comprising the steps of: providing a cathode substrate; depositing a plurality of emitter lines on the cathode substrate; providing a gate frame including a plurality of gate wires; and positioning the gate frame over the cathode substrate.

In a further embodiment, the invention may be characterized as a method of operating a field emission display comprising the steps of: applying a first voltage potential between an emitter line of a cathode substrate and one or more gate wires of a gate frame positioned over the cathode substrate; generating an electric field over a portion of the emitter line below and in between the one or more gate wires; and emitting electrons from the portion of the emitter line.

BRIEF DESCRIPTION OF THE DRAWINGS

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION

The following description is not to be taken in a limiting sense, but is made merely for the purpose of describing the general principles of the invention. The scope of the invention should be determined with reference to the claims.

According to several embodiments of the invention, an improved field emission display (FED) is provided which advantageously employs linear cathode emitters on a cathode substrate and corresponding linear phosphors on an anode plate. Furthermore, the FED also includes a frame-type gate having linear gate wires positioned above and crossing over respective linear cathode emitters. Advantageously, the linear structure of the emitters, phosphors, and gate wires enables simplified manufacturing and alignment of the components of the FED. Additionally, this linear structure also provides an analog-like variable resolution not provided in conventional FEDs by addressing half-pixels. As such, an FED is provided with higher resolution and improved clarity and brightness in comparison to conventional fixed pixel FEDs.

Figure 4:
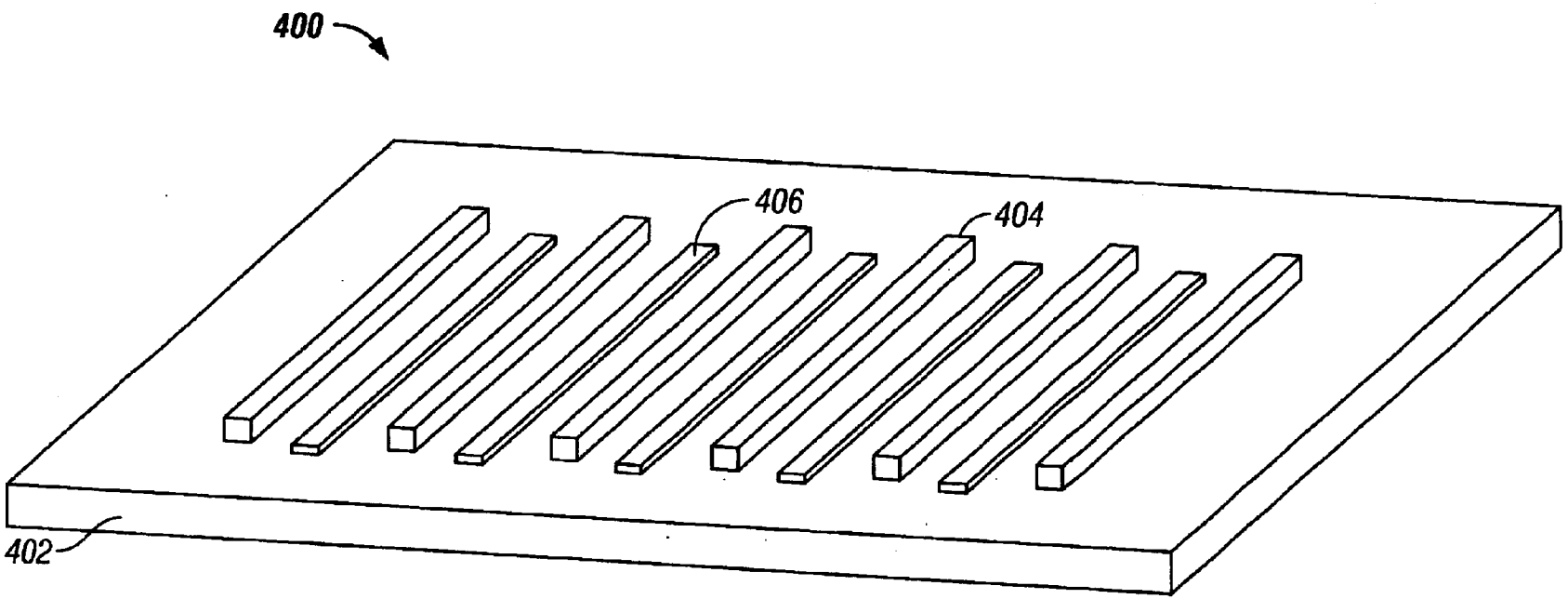
FIG. 4 is a perspective view of a cathode plate of an FED including emitter lines and ribs according to one embodiment of the invention.

Referring to FIG. 4, a perspective view is shown of a cathode plate of a field emission display (FED) including emitter lines and ribs according to one embodiment of the invention. A cathode plate 400 includes a cathode substrate 402 having ribs 404 (also referred to as barrier ribs or generically referred to as "linear isolation barriers") on a top surface of the cathode substrate 402. The ribs 404 are generally aligned co-linearly in one direction across the cathode substrate 402 and are positioned at intervals across the cathode substrate 402. Thus, the ribs 404 are generally aligned in parallel across the top surface of the cathode substrate 402. In between respective ribs 404, emitter lines 406 are also formed on the top surface of the cathode substrate 402. The emitter lines 406 comprise a low work function material that easily emits electrons, for example, a carbon-based material such as carbon graphite, nanotube or polycrystalline carbon. Additionally, those skilled in the art will recognize that the emitter lines 406 may comprise any of a variety of emitting substances, not necessarily carbon-based materials, such as an amorphous silicon material, for example. The emitter lines 406 are deposited on the top surface of the cathode substrate 402. Generally, the emitter lines 406 are oriented in between respective pairs of ribs 404 and are parallel to the orientation of the ribs 404 on the cathode substrate 402. For example, as shown, a respective emitter line 406 is positioned between respective pairs of the ribs 404 such that the ribs 404 and emitter lines 406 are in parallel. In one embodiment, the ribs 404 are in parallel to the emitter lines 406 to each other and with one side of the cathode substrate 402 (e.g., the width of the cathode substrate) and perpendicular to another side of the cathode substrate 402 (e.g., the length of the cathode substrate).

The ribs 404 have a low aspect ratio and form barriers that separate emitter lines 406 from each other in order to provide field isolation and to reduce the spread of electrons emitted from the emitter lines 406. Furthermore, the ribs 404 are used to provide mechanical support for gate wires of a gate frame as further described below. The ribs 404 comprise a dielectric or non-conducting material that may be adhered to the cathode substrate 402. Alternatively, the ribs 404 may be applied to the cathode substrate 402. In another embodiment, a dielectric layer may be formed over the cathode substrate 402 and then etched back to form the ribs 404.

Figure 1:
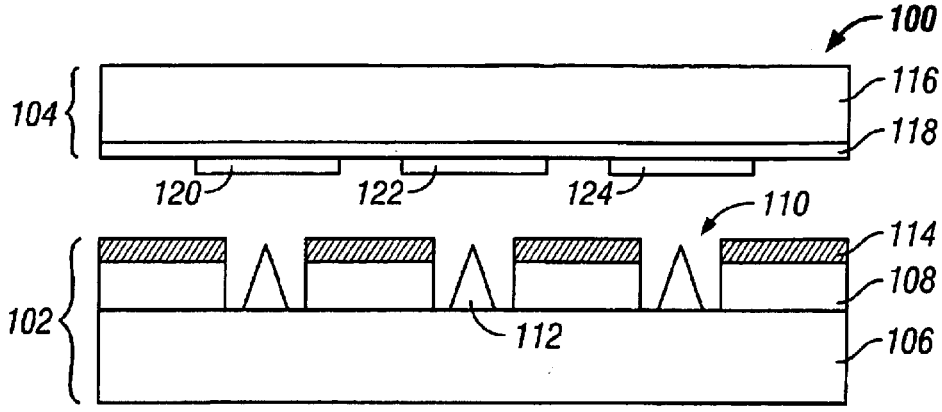
FIG. 1 (Prior Art)
FIG. 1 is a side cut-away view of a conventional field emission display (FED)
Figure 2:
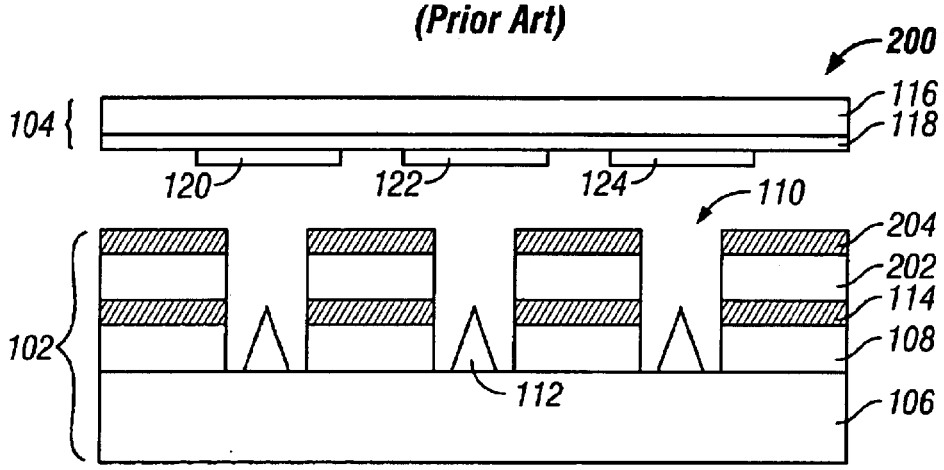
FIG. 2 (Prior Art)
FIG. 2 is a side cut-away view of a conventional FED including a focusing electrode.
Figure 3:
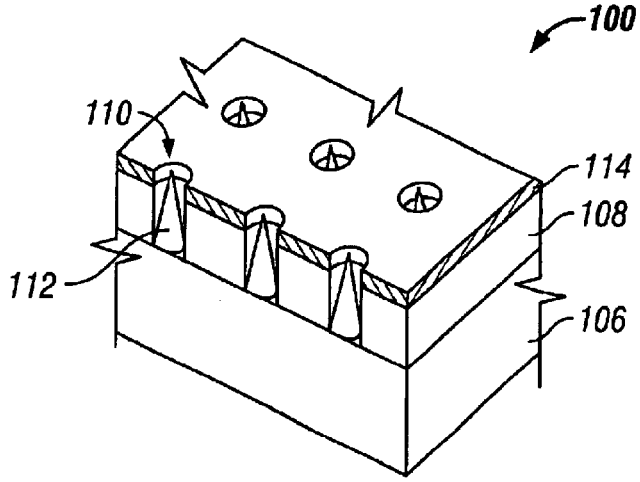
FIG. 3 (Prior Art)
FIG. 3 is a cut-away perspective view of the conventional FED of FIG. 1.

The emitter lines 406 are in contrast to the known art, which use conical emitters having sharp points separated from adjacent conical emitters by the structure of the dielectric layer, e.g., the first dielectric layer 108, as shown in FIGS. 1–3. The emitter material is deposited as a smooth linear layer on the cathode substrate 402. It is noted that in some embodiments, more than one emitter line 406 is formed in between a respective pair of ribs 404. As will be described in more detail, this uniform, smooth layer is important to producing a uniform electron emission from the emitter line 406. However, it is noted that in alternative embodiments, the emitter lines 406 may be made substantially uniform. For example, the emitter line 406 comprises many tiny emitter cones positioned very closely together and in a linear fashion, such that collectively, the many emitter cones function as an emitter line 406. In this embodiment, there is no separating structure in between individual cones. This is in contrast to the individual emitter cones located within emitter wells as shown in FIGS. 1–3. In another embodiment, the emitter line 406 may be made such that it is uneven, or has bumps, throughout the length of the emitter line 406. In either case, the emitting material of the emitter line 406 is deposited to be substantially flat and substantially uniformly distributed along the length of the emitter line 406.

Figure 5:
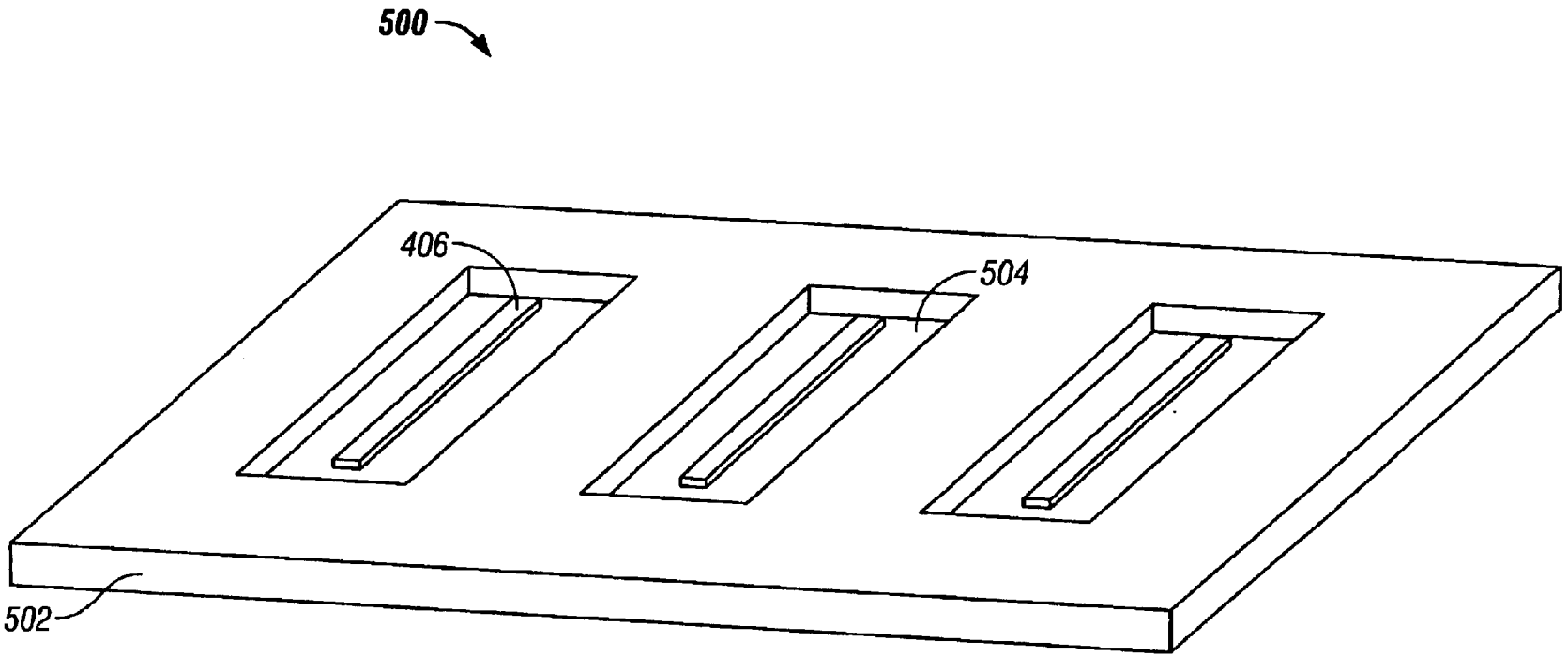
FIG. 5 is a perspective view of a cathode plate of an FED including emitter lines and trenches formed within the cathode substrate in accordance with another embodiment of the invention.

Referring next to FIG. 5, a perspective view is shown of a cathode plate of a field emission display (FED) including emitter lines and trenches formed within the cathode substrate in accordance with another embodiment of the invention. In this embodiment, a cathode plate 500 includes a cathode substrate 502 having trenches 504 formed within a top surface of the cathode substrate 502. Within each trench 504 is deposited a respective emitter line 406 as described above. The trenches 504 are etched into the cathode substrate 502, and thus, have a low aspect ratio. The trenches 504 function as isolation barriers between respective emitter lines 406; thus, the trenches 504 may also be referred to generically as "in-laid linear isolation barriers". The trenches 504 provide field isolation and reduce electron spreading of the electrons emitted from the emitter lines 406. Also, the trenches provide mechanical support for gate wires of a gate frame as is further described below. It is noted that in some embodiments, more than one emitter line 406 is formed within a respective trench 504.

Figure 6:
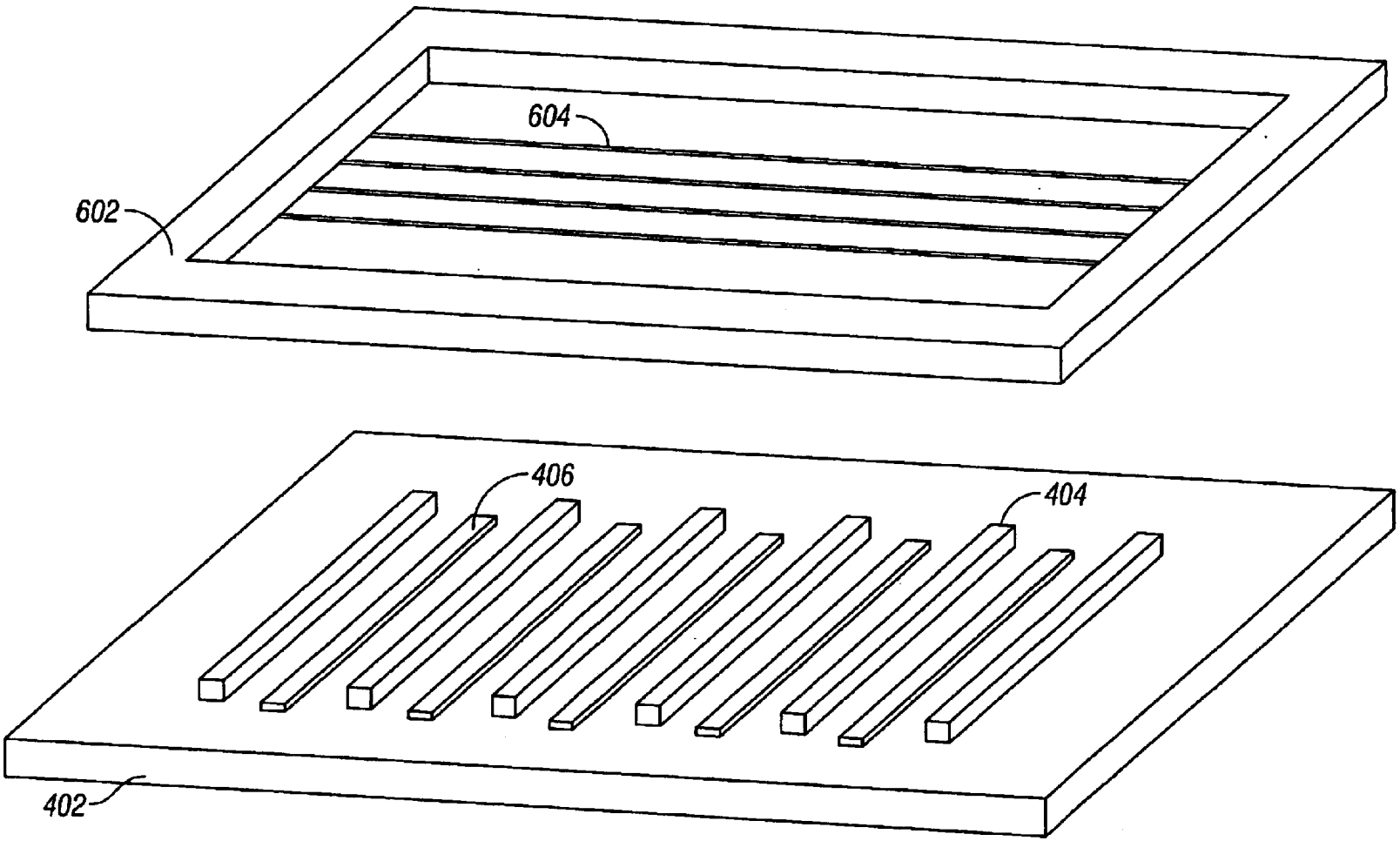
FIG. 6 is a perspective view of the cathode plate of FIG. 4 further including a gate frame in accordance with another embodiment of the invention.
Figure 8:
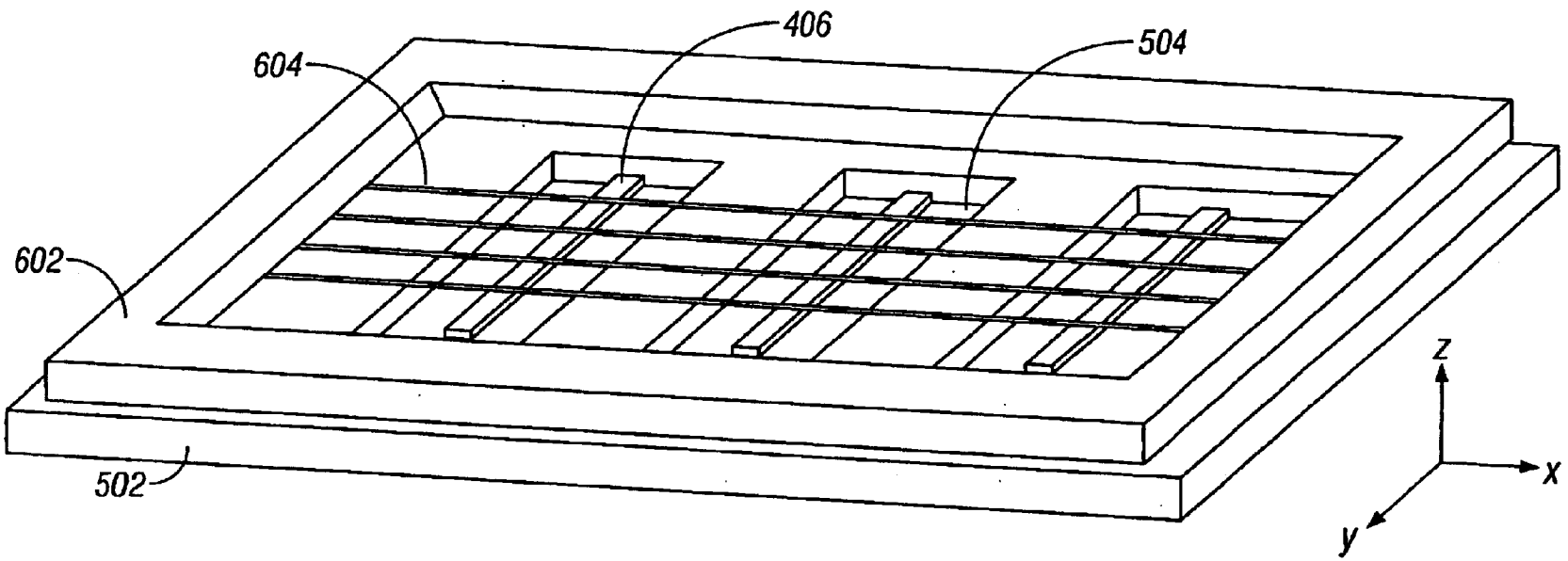
FIG. 8 is a perspective view of the cathode plate of FIG. 5 having a gate frame with gate wires attached thereto in accordance with yet another embodiment of the invention.

Referring next to FIG. 6, a perspective view is shown of the cathode plate of FIG. 4 further including a gate frame having gate wires in accordance with another embodiment of the invention. A gate frame 602 is provided having plurality of gate wires 604. The gate frame 602 is designed to be positioned over the ribs 404 and emitter lines 406 of the cathode plate 400, or alternatively as shown in FIG. 8, positioned over the trenches 504 and emitter lines 406 of the cathode substrate 502 of FIG. 5. The gate wires 604 are thin, tensioned wires that span from one side of the gate frame to an opposite side. In the embodiment shown, the gate frame 602 is generally rectangularly shaped similar to the cathode plate 400. The gate wires 604 are oriented in parallel to each other and in this embodiment, are attached to the bottom surface of the gate frame 602. The gate frame 602 and the gate wires 604 function similarly to the gate electrode of a conventional FED; however, this frame-type gate is a separate component of the FED which is distinct from the cathode plate. In contrast, the gate electrode of a conventional FED is an integral component of the cathode plate. The gate frame 602 and gate wires 604 are similar to an aperture grill found in CRT displays and may be comprised of a metallic or ceramic material.

Figure 7:
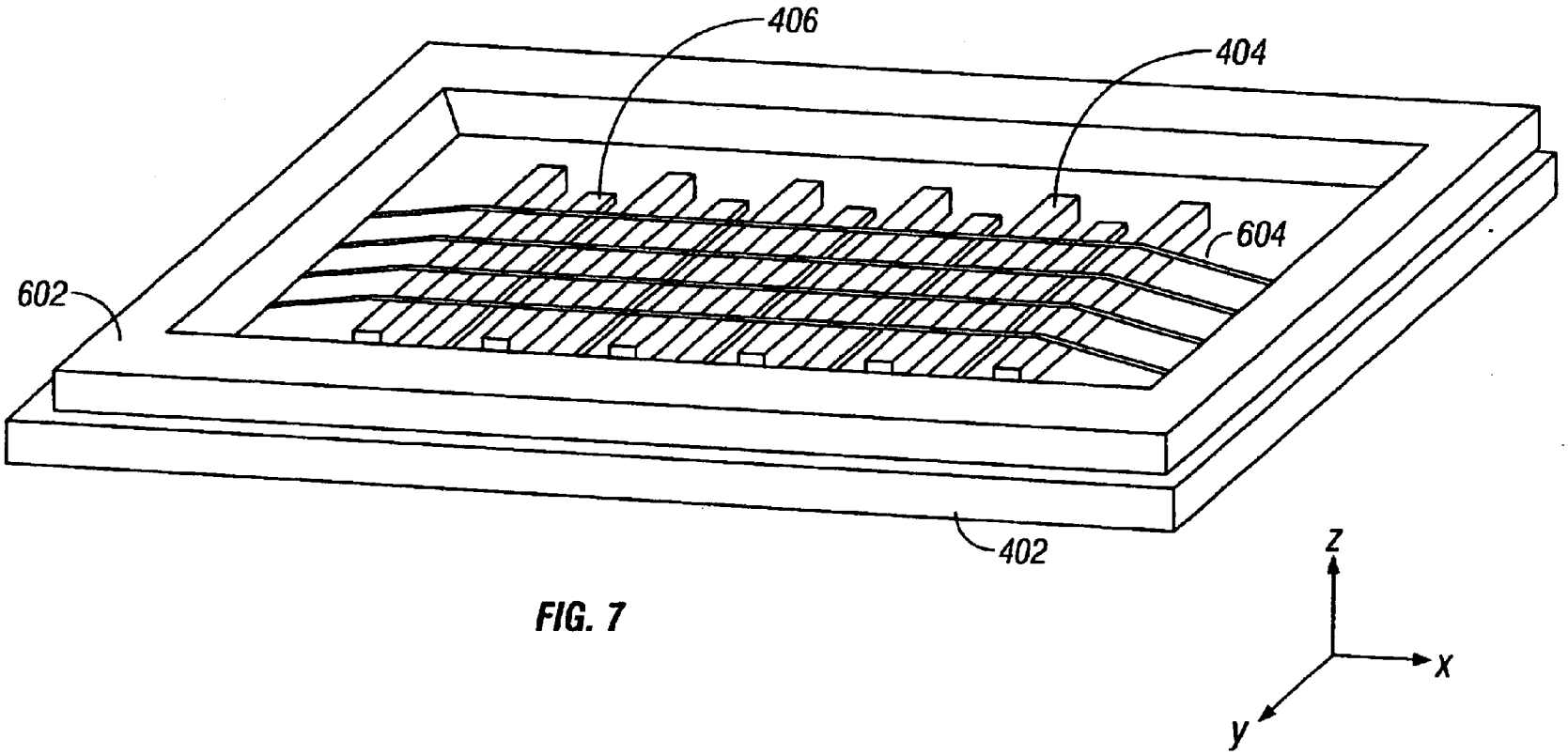
FIG. 7 is a perspective view of the cathode plate and gate frame of FIG. 6 attached together.

Referring next to FIG. 7, a perspective view is shown of the cathode plate and gate frame 602 of FIG. 6 attached together. The gate frame 602 is positioned over the top surface of the cathode substrate 402 such that the gate wires 604 contact the ribs 404 of the cathode substrate 402. The ribs 404 act to place a slight amount of tension in the gate wires to dampen vibrations in the gate wires 604 from the driving frequency. Additionally, the ribs 404 provide mechanical support for the gate wires 604 above the emitter lines 406 such that the gate wires 604 do not contact the emitter lines 406. In this embodiment, the gate wires 604 are oriented along parallel lines that are perpendicular to the parallel lines of the ribs 404 and emitter lines 406. However, it is noted that the gate wires 604 and the emitter lines 406 may be oriented such that they are other than perpendicular to each, for example, the angle between the gate wires 604 and the emitter lines 406 may be other than 90 degrees, such as any angle between 10 and 90 degrees. This FED design is a departure from the known art in that the component that functions similarly to the gate electrode (i.e., the gate frame 602 and gate wires 604) is a separate physical component of the FED that is not integral to the cathode substrate. As described with reference to FIGS. 1–3, the conventional gate electrode comprises a layer formed on top of a dielectric material on the cathode substrate, not a separate structure as the gate frame 602. As such, the manufacture of the FED is improved since the cathode plate and the gate frame 602 are separately manufactured. Thus, a defect in one will not result in discarding both.

Furthermore, the gate frame 602 of this embodiment does not have to be precisely aligned with respective electron emitters in both x and y directions, as does the conventional gate electrode over emitter tips. The gate frame 602 only need be simply positioned over the emitter lines 406 such that the gate wires 604 intersect the plane of the emitter lines but do not contact the emitter lines 406. In this configuration, the gate wires 604 define cathode sub-pixels regions on the respective emitter lines 406 as portions of the emitter lines in between two adjacent gate wires 604.

Referring next to FIG. 8, a perspective view is shown of the cathode plate of FIG. 5 having a gate frame with gate wires attached thereto in accordance with yet another embodiment of the invention. The gate frame 602 including the gate wires 604 of FIG. 6 is positioned over the cathode substrate 502 such that the gate wires 604 contact the top surface of the cathode substrate 502. However, since the emitter lines 406 are deposited within the trenches 504, the gate wires 604 do not contact the emitter lines 406. Thus, the trenches 604 function similarly to the ribs 404 of FIG. 7 in that they isolate emitter lines 406 from each other, but are laid into the thickness of the cathode substrate 502 for a lower aspect ratio than the linear ribs of FIG. 7. The tensioned gate wires 604 are also mechanically supported by the top surface of the cathode substrate 502 in between adjacent trenches 504 in order to dampen vibrations in the gate wires 604 due to the driving frequency. Again, the gate wires 604 are oriented along parallel lines that are perpendicular to the parallel lines of the ribs 404 and emitter lines 406. It is noted again, that it is not required that the gate wires 604 and the emitter lines 406 are oriented as perpendicular to each other, as long as the gate wires 604 cross over the emitter lines 406. Thus, the gate wires 604 and the emitter lines 406 may be oriented at angles between about 10 and 90 degrees relative to each other.

Advantageously, in this configuration, the gate wires 604 are used to define portions of the emitter lines 406 into cathode sub-pixel regions. Thus, a respective portion of a respective emitter line positioned in between two adjacent gate wires is generally defined as a cathode sub-pixel region.

The designs of FIGS. 7 and 8 provide a structure such that when a voltage potential is applied to a respective emitter line 406 and one or more gate wires 604, electrons are emitted from one or more portions of the emitter line 406, i.e., from one or more cathode sub-pixel regions. This enables novel addressing techniques as applied to FEDs, which are further described below.

Figure 9:
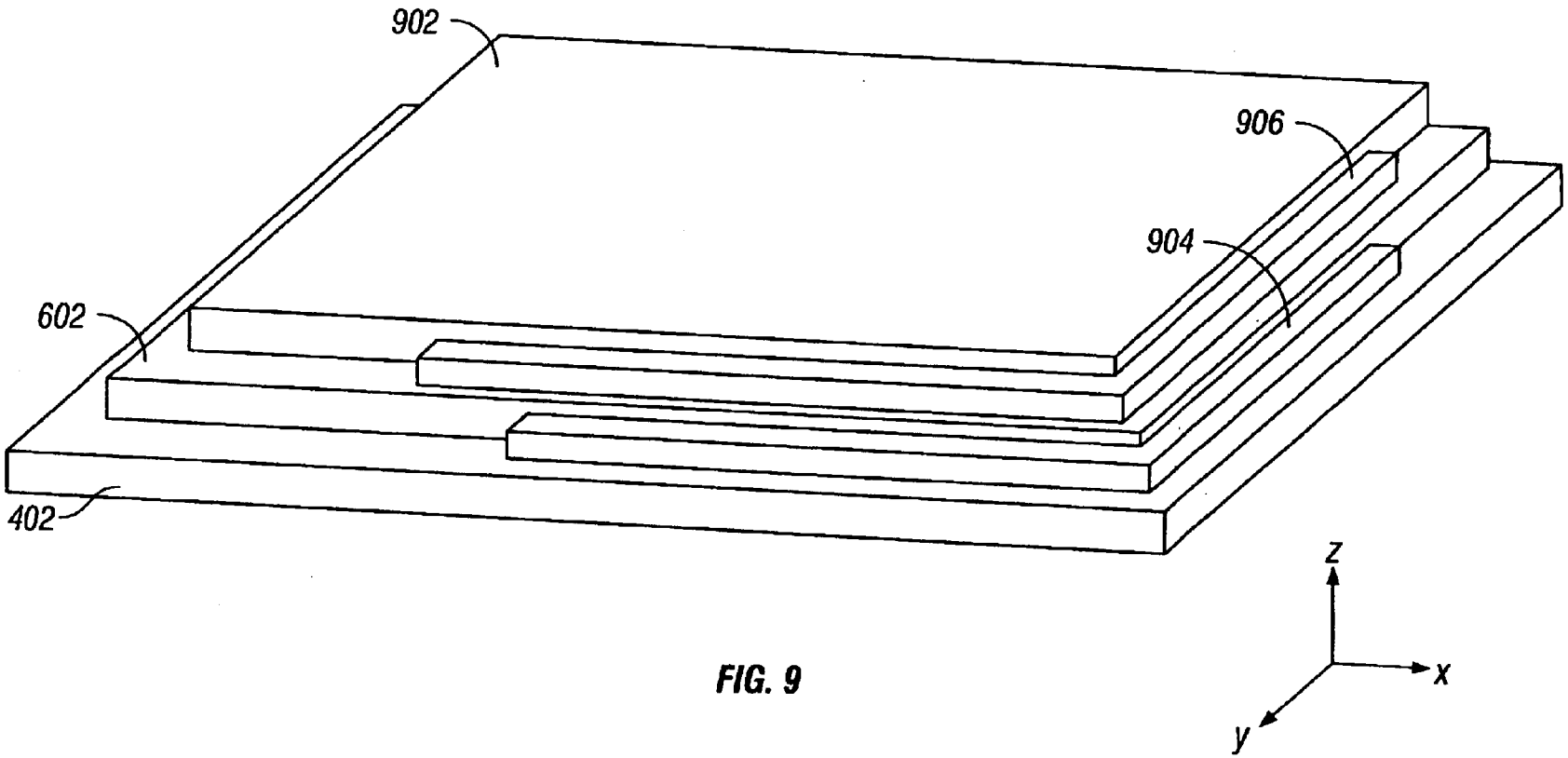
FIG. 9 is a perspective view of the cathode plate of FIG. 4 or FIG. 5 including the gate frame of FIG. 6 and further including alignment barriers for aligning the cathode plate, the gate frame, and an anode substrate in accordance with an additional embodiment of the invention.

Referring next to FIG. 9, a perspective view is shown of the cathode plate of FIG. 4 or FIG. 5 including the gate frame of FIG. 6 and further including alignment barriers for aligning the cathode plate, the gate frame, and an anode plate in accordance with an additional embodiment of the invention. Further in the manufacture of an FED device, an anode plate 902 is positioned over the gate frame in order to complete the FED. The anode plate 902 is generally a transparent plate that includes phosphor materials applied to a bottom surface of the anode plate 902, e.g., the surface of the anode plate 902 not illustrated in FIG. 9. Additionally, a metalized anode material is applied over the phosphor materials, such that when a potential is applied to the metalized anode material, emitted electrons are accelerated toward the respective phosphors. According to this embodiment and as further described below, the phosphor material is linearly deposited on the anode plate 902 as lines of a respective phosphor material, such as a red phosphor line, a blue phosphor line and the green phosphor line. The phosphor lines are positioned directly above and parallel to the respective emitter lines. Furthermore, the anode plate 902, the gate frame 602 and the cathode plate are vacuum-sealed together to create the FED.

In manufacture, the gate frame 602 is aligned and sealed onto the cathode substrate 402 and the anode frame 902 is aligned and sealed onto the gate frame 602. Advantageously, since the electron emitters are in the form of emitter lines 406 and the gate wires 604 are positioned over the emitter lines 406 perpendicular to the direction of the emitter lines, the gate frame 602 is not required to be aligned precisely in either x or y direction, e.g., the gate frame should be positioned so that the gate wires cross over the emitter lines. What is important according to this embodiment is that the emitter lines align with the phosphor lines (not shown) on the anode plate. This is in contrast to known FEDs in which the conventional gate electrode must precisely align with the conical electron emitters in both the x and y directions. This is why the conventional gate electrode is formed as a layer integral with the cathode substrate and the emitter wells are then cut out of the gate electrode. Thus, the conventional FED will have precise alignment of the emitter wells of the gate electrode and the emitters of the cathode substrate in both x and y directions.

In order to properly align the emitter lines of the cathode substrate 402 with the phosphor lines of the anode plate 902, alignment barriers are used according to one embodiment of the invention. For example, in this embodiment, a first alignment barrier 904 is adhered to the top surface of the cathode substrate 402. The first alignment barrier 904 is a corner piece or corner chuck that is sized such that an exterior dimension of the gate frame 602 will fit flush within the inner dimensions of the first alignment barrier 904. Once the first alignment barrier 904 is secured in position on the cathode substrate 402, the gate frame 602 is positioned on the cathode substrate 402 and against the first alignment barrier 904 with an appropriate sealing material (e.g., frit) in between. In one embodiment, the first alignment barrier 904 is not intended to be removed and becomes a part of the FED. It is noted that the first alignment barrier 904 allows the gate wires of the gate frame 602 to be positioned to cross over the emitter lines.

The anode plate 902 is then aligned with the cathode plate 402 and the gate frame 602 such that the phosphor lines (on the anode plate 902) are substantially aligned with the emitter lines on the cathode substrate 402 below. It is noted that the phosphor lines only need to precisely align with the emitter lines in a single direction, e.g., the x direction, as opposed to precise alignment in both the x and y directions as required in conventional FEDs. In order to align the anode plate 902 on the gate frame 602 such that the phosphor lines align with the emitter lines, a second alignment barrier 906 is secured on a top surface of the gate frame 602 and is sized to fit flush with a portion of the exterior dimension of the anode plate 902 within its inner dimension. In this embodiment, the second alignment barrier 906 is formed to fit a corner of the anode plate 902. The anode plate 902 is then positioned on the gate frame 602 and flush against the second alignment barrier 906 with an appropriate sealing material (e.g., frit) placed therebetween. Again, in this embodiment, the second alignment barrier 906 is not intended to be removed and becomes a part of the FED.

Next, the entire assembly, including the cathode plate, the gate frame 602 and the anode plate 902 is held upright at an angle such that the gate frame 602 rests completely flush against the first alignment barrier 904 and the anode plate rests completely flush against the second alignment barrier 906 while the components are vacuum sealed together. This process is similar to the sealing of the funnel and faceplate of a conventional CRT, although this CRT sealing process uses alignment frames that do not become an integral component of the display device once the sealing is complete. In contrast, the first and second alignment barriers 904 and 906 are not removed after alignment and become a part of the FED.

It is noted that the alignment barriers are embodied as corner pieces or chucks; however, the alignment barriers may be formed in separate pieces and may be designed to fit flush against two or more sides of the gate frame 604 and/or the anode plate 902. For example, the first and second alignment barriers 904 and 906 may each comprise two separate straight alignment pieces positioned to act as a corner piece or corner chuck. It is noted that it is not required that these separate straight alignment pieces actually meet at a corner, but only that the alignment pieces be positioned to properly align the gate frame 604 and the anode plate 902.

The first and second alignment barriers 904 and 906 provide a simple and easy method of aligning and controlling the position of the main components of the FED together during fabrication. It is noted that although not required, in this embodiment, the first alignment barrier 904 should be carefully attached to the cathode substrate 402 so that the position of the gate frame 602 is generally in the same orientation on the cathode substrate 402. This may assist in the placement of the second alignment barrier 906 so that the anode plate 902 can be aligned above the cathode plate 402. Thus, and regardless of how carefully the gate frame 602 is aligned above the cathode plate 402, the second alignment barrier 906 should be carefully attached to the gate frame 602 such that the phosphor lines will align with the emitter lines precisely in the desired direction (i.e., the x direction).

Figure 10:
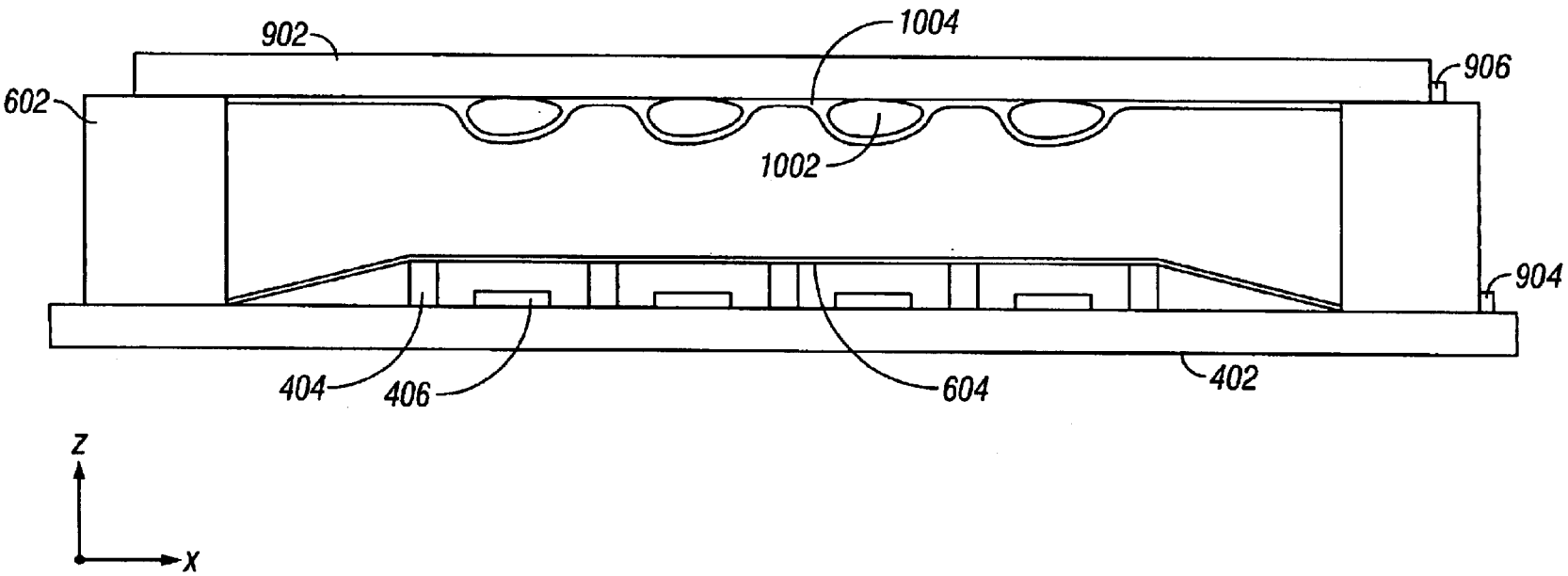
FIG. 10 is a side cut-away view of the FED of FIG. 9 illustrated with the cathode plate of FIG. 4.

Referring next to FIG. 10, a side cut-away view is shown of the field emission display (FED) of FIG. 9 illustrated with the cathode plate of FIG. 4. As can be seen, the gate wires 604 are held in position above the emitter lines 406 (shown as a cross section) by the ribs 404. Additionally, phosphor lines 1002 are illustrated in a cross sectional view so that the length of the phosphor lines 1002 is not visible. These phosphor lines 1002 extend linearly a length of the anode plate 902 and are aligned above and parallel to a respective emitter line 406. Furthermore, the anode plate 902 also includes an anode material 1004, to which a potential may be applied to accelerate electrons toward the phosphors lines. The anode material 1004 is illustrated as a thin coating that is applied over the top of phosphor lines 1002 and the transparent anode plate 902. It is noted that alternatively, the anode material 1004 may be formed on the transparent anode plate 902 with the phosphor lines 1002 formed over the anode material 1004. Thus, according to one embodiment, the anode plate includes a transparent anode plate 902, multiple phosphor lines 1002 and an anode material 1004 deposited to contact the multiple phosphor lines 1002. Also illustrated are the first and second alignment barriers 904 and 906 used to align and attach the gate frame 602 to the cathode substrate 402 and the anode plate 902 to the gate frame 602.

In operation, by selectively applying a voltage potential to a respective emitter line 406 and one or more gate wires 604, selected portions of the emitter line 406 will emit electrons toward and illuminate a respective portion of the phosphor line 1002 formed on the anode plate above. Furthermore, as is similarly done in conventional pixilated FEDs, in order to affect the brightness of the illuminated portion of the phosphor lines, a potential is also applied to a metalized anode material to accelerate the electron emission toward the phosphor lines 1002. FIG. 10 also illustrates the alignment of the phosphor lines 1002 over respective ones of the emitter lines 406.

Advantageously, the linear structure of the emitter lines 406, gate wires 604 and the phosphor lines 1002 enables a variable resolution FED device as is further described below, which is a contrast from known pixelated FEDs. Furthermore, in comparison to conventional FEDs, the FEDs of several embodiments of the invention will be brighter than conventional FEDs since more surface area of the anode plate 902 is taken up by phosphor material. That is, the phosphor lines 1002 occupy more surface area of the anode plate 902 that individual phosphor dots on a conventional FED. Furthermore, depending on the physical dimensions of the FED, it is noted that the FED device may also incorporate spacers (not shown) that will prevent the anode plate 902 from collapsing on the cathode plate 402. These spacers may be implemented as one or more thin wall segments evenly spaced across the cathode plate (preferably parallel to the ribs, trenches, or other embodiment of the isolation barriers). Alternatively, these spacers may be implemented as support pillars that are evenly spaced across the cathode substrate.

Figure 11:
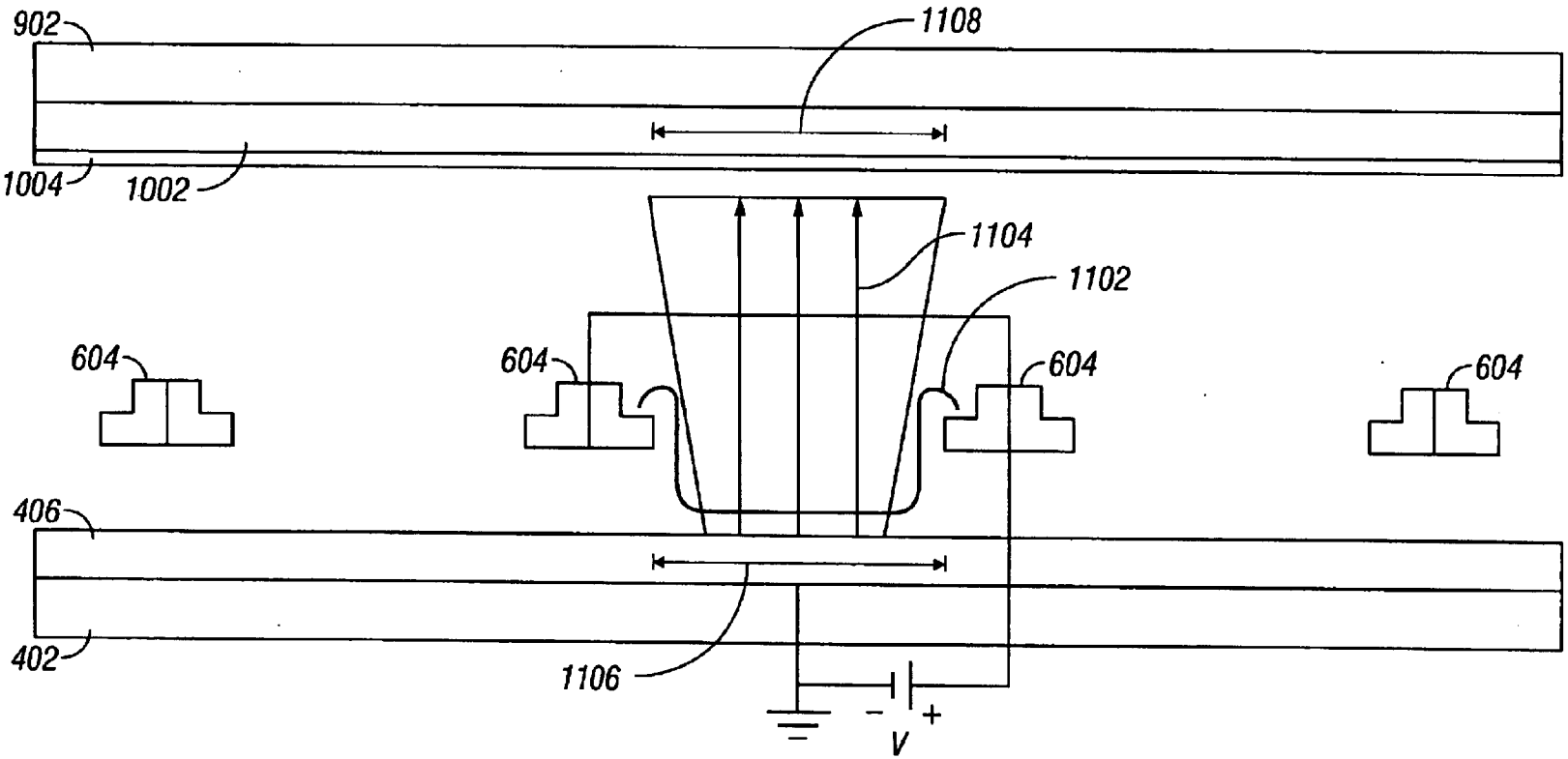
FIG. 11 is a side cut-away view of a portion of the length of a single emitter line and a corresponding phosphor line and gate wires (in cross sectional view), and which further illustrates an electric field generated and a corresponding electron emission in the use of the FEDs of several embodiments of the invention.

Referring next to FIG. 11, a side cut-away view is shown of a portion of the length of a single emitter line and a corresponding phosphor line and the cross sectional view of several gate wires, and which further illustrates an electric field generated and a corresponding electron emission in the use of the FED according to an embodiment of the invention. A potential, illustrated as a voltage V is applied to two adjacent gate wires 604 and an emitter line 406, which generates an electric field 1102 generally shaped as illustrated. This electric field 1102 causes electrons to be released, illustrated as electron emission 1104, from the portion of the emitter line 406 in between the two adjacent gate wires 604 toward a portion of a phosphor line 1002 on the anode plate 902 above. The specific characteristics of an embodiment of the electric field 1102 are further described with reference to FIGS. 13A and 13B. This portion of an emitter line 406 between two adjacent gate wires 604 defines a single cathode sub-pixel region 1106 (also referred to as a cathode sub-pixel) of the cathode of the FED. Thus, cathode sub-pixel regions are not defined as individual emitter cones of conventional FEDs, but as portions of the emitter lines 406 bounded by gate wires 604 positioned above the emitter lines 406. Similarly, anode sub-pixel regions 1108 (also referred to as anode sub-pixels) are defined as portions of the corresponding phosphor lines 1002 that are above directly above, and thus correspond to, the respective cathode sub-pixel regions 1106. Also shown is the anode material 1004 that is applied over the phosphor line 1002. In operation, a potential is also applied to the anode material 1004 in order to accelerate the electron emission 1104 toward the respective anode sub-pixel region 1108 of the phosphor line 1002.

Referring next to FIGS. 12A–12D, top views are shown of emitter lines and gate wires of the field emission display of FIG. 10 illustrating various driving and addressing techniques in accordance with several embodiments of the invention. Shown are gate wires 1202, 1204, 1206, and 1208, emitter line 406, and cathode sub-pixel regions 1210, 1212 and 1214.

Figure 12A:
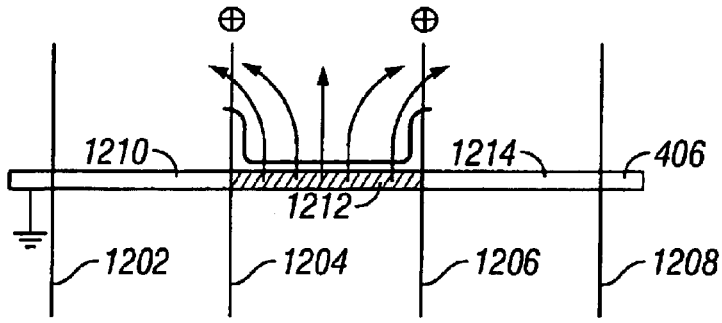
FIGS. 12A through 12D are top views of emitter lines and gate wires of the FED of FIG. 10 illustrating various addressing techniques in accordance with several embodiments of the invention.

FIG. 12A illustrates the basic driving technique used to address a given cathode sub-pixel region of the FED. The FED is driven by applying a voltage potential between two adjacent gate wires 1204 and 1206 and a respective emitter line 406. This is illustrated as a positive voltage on the respective gate wires 1204 and 1206 and the emitter line 406 at ground. The potential causes the portion of the emitter line 406 between the two adjacent gate wires 1204 and 1206, i.e., cathode sub-pixel region 1212 to emit electrons towards the phosphor material on the anode above. Thus, cathode sub-pixel region 1212 is turned on. In reality, the electrons emitted from the cathode sub-pixel region 1212 may tend to curve slightly toward the two adjacent gate wires 1204 and 1206, as illustrated, although the electron emission is designed to be as straight as possible. In one embodiment, it is preferable that the electric field generated is such that the electron emission is as straight as possible in order to reduce the spread of electrons (see FIGS. 11 and 13A). It is noted that since the view of FIG. 12A (and also FIGS. 12B–12D are top views), the electron emission is actually emitted vertically up from the plane of the illustration; however, for illustration purposes, it is shown as being emitted from the side of the emitter line 406.

Figure 12B:
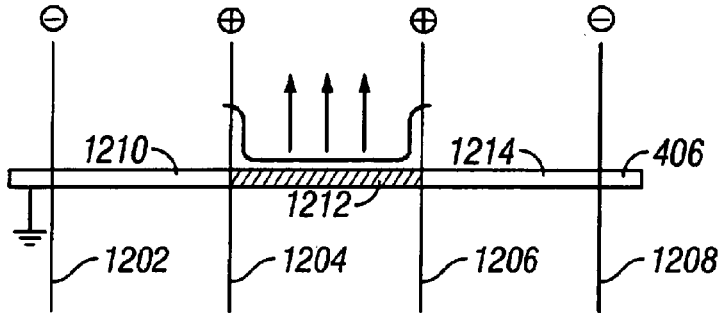

FIG. 12B illustrates a technique of driving the cathode sub-pixel regions of the cathode plate such that tertiary or peripheral gate wires are used to reduce the spread of electrons emitted from a respective cathode sub-pixel region. This technique is similar to that shown in FIG. 12A; however, a negative potential is applied to the gate wires 1202 and 1208. Gate wires 1202 and 1208 are the gate wires further away from cathode sub-pixel region 1212 and next to gate wires 1204 and 1206, respectively. Thus, gate wires 1202 and 1208 are referred to as peripheral gate wires. Advantageously, a properly selected negative potential with respect to the emitter line 406 collimates the electron emission from cathode sub-pixel region 1212 into a straight emission. This has the effect of reducing the electric field generated, which reduces electron spreading of the electron emission. Thus, this focuses the electron beam emitted toward a phosphor or anode sub-pixel region of the anode plate. It is noted that this is a departure from known FEDs, which use separate focusing grids (see the focusing electrode 204 of FIG. 2) that are distinct from the conventional gate electrode. Advantageously, in this embodiment, the same component that functions similarly to a conventional gate electrode is also used to focus or reduce electron spread, rather than a separate focusing grid or electrode. It is also noted that it is not required that the peripheral gate wires used to focus the electron emission be those gate wires immediately adjacent to the gate wires 1204 and 1206. For example, the peripheral gate wires may be other gate wires located further away from gate wires 1204 and 1206 such that they may collimate the electron emission with the proper potential applied thereto.

Figure 12C:
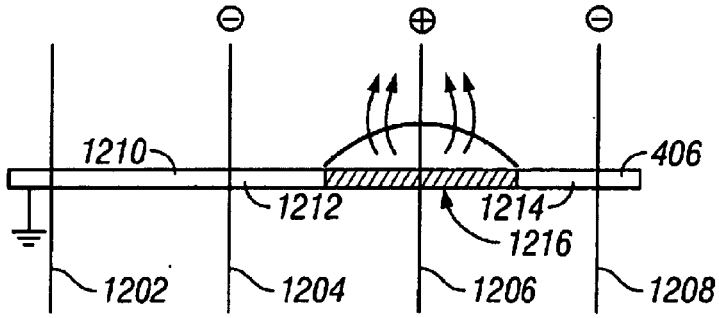

FIG. 12C illustrates another embodiment of a driving technique, which enables cathode half-pixel addressing similar to that of a CRT using an aperture grill. In this embodiment, a positive voltage is applied to the gate wire 1206 relative to the grounded emitter line 406. Additionally, a negative voltage is applied to gate wires 1204 and 1208 with respect to the grounded emitter line 406. This generates an electric field that causes electrons to be emitted from approximately half of cathode sub-pixel region 1212 and approximately half of cathode sub-pixel region 1214, which is labeled as cathode half-pixel region 1216. Advantageously, this appears as though an anode sub-pixel region (a dot) in between two previously defined anode sub-pixel regions (two dots) of the phosphor line is illuminated. As such, an anode half-pixel region is defined as a portion of a phosphor line occupying portions of two adjacent anode sub-pixel regions. This is illustrated in FIG. 12F. This creates the appearance of a greater resolution than is physically there, or in other words, creates a pseudo resolution. For example, by applying half-pixel addressing and varying the intensity level of the electron emission, an FED is created which appears to have much greater resolution that it actually has. Thus, such an FED will have a higher clarity than a fixed pixel conventional FED. Therefore, analog-like performance is created since the designer can obtain a variable resolution on a fixed pixel display. This is a departure from known FEDs, which provide fixed performance in resolution due to the fixed number of cathode sub-pixels (i.e., the fixed number of electron emitters 112 or emitter cones of FIGS. 1–3). This half-pixel addressing is similar to half pixel addressing techniques performed in CRT type devices employing an aperture grill design. Such an example of a conventional CRT including an aperture grill includes TRINITRON CRTs produced and commercially available from the Sony Electronics Inc., of Park Ridge, N.J., USA.

Figure 12D:
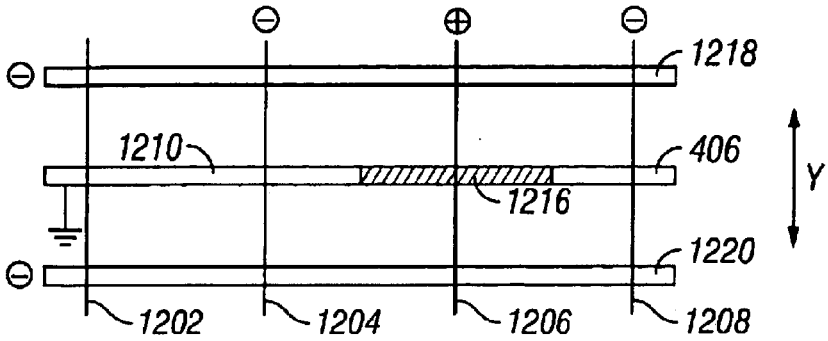

FIG. 12D illustrates another embodiment for biasing the electron emission from cathode half-pixel region 1216 as generated in FIG. 12C by applying a negative voltage at emitter lines 1218 and 1220, which are adjacent to emitter line 406. This results in a focusing of the electron emission in the y-direction as illustrated in FIG. 12D. This biasing effect can also be applied in the addressing and driving techniques shown in FIGS. 12A and 12B. It is noted that in all of the embodiments illustrated in FIGS. 12A–12D, the driving and addressing of the cathode sub-pixel regions of the emitter lines of the FED, e.g., the application of appropriate potentials of varying intensities to respective sub-pixels, is controlled via addressing/driving software programmed to drive the FED to create desired images. Such driving software is similar to that employed in the TRINITRON CRTs produced by Sony Electronics Inc., as described above. It is within the ability of one skilled in the art to generate the software to properly address the emitter lines and gate wires of several embodiments of the FEDs disclosed herein in order to implement the addressing and driving techniques of the embodiments of FIGS. 12A–12D.

Figure 12E:
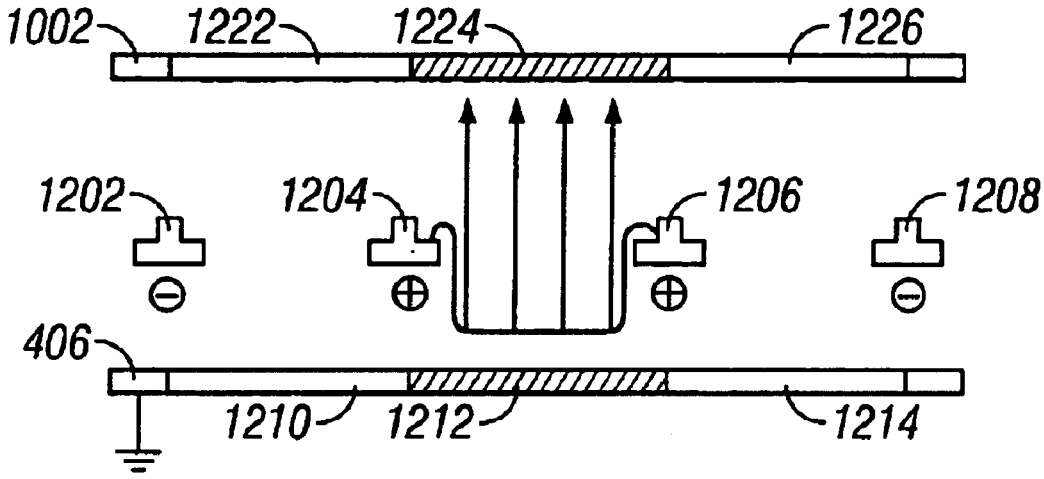
FIGS. 12E and 12F are side cut-away views of a portion of the length of a single emitter line and phosphor line illustrating the various addressing techniques shown in FIGS. 12B and 12C, respectively.
Figure 12F:
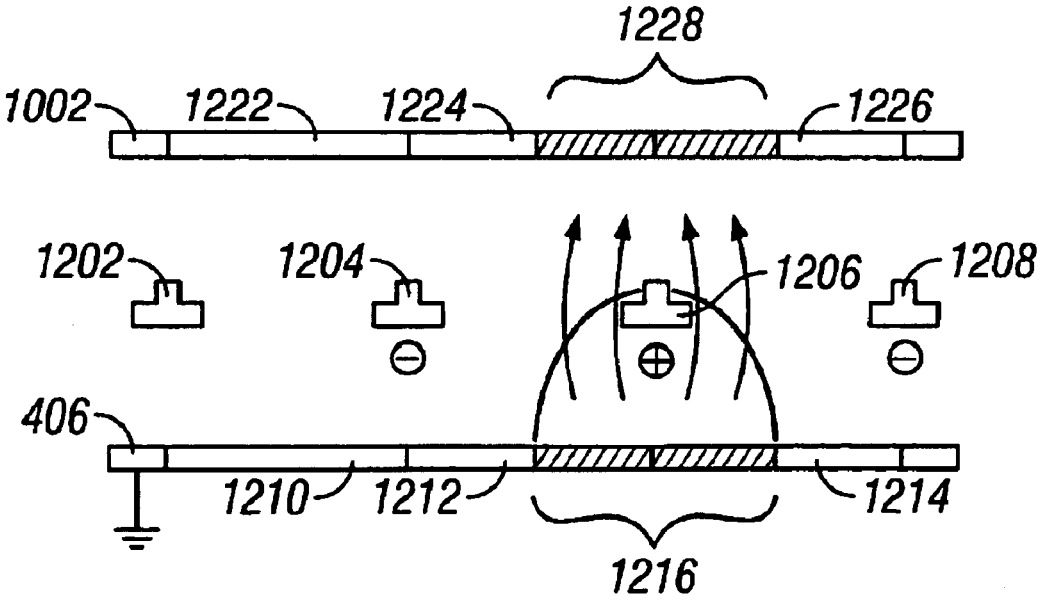

Referring next to FIGS. 12E and 12F, side cut-away views are shown of a portion of the length of a single emitter line and phosphor line illustrating the various addressing and driving techniques shown in FIGS. 12B and 12C, respectively. In FIG. 12E, by applying a positive voltage to gate wires 1204 and 1206 and a negative voltage to gate wires 1202 and 1208 with respect to the emitter line 406, cathode sub-pixel region 1212 emits electrons which illuminate anode sub-pixel region 1222. Thus, FIG. 12E is a side view of FIG. 12B. Thus, as is seen, the phosphor line 1002 is defined as including anode sub-pixel regions 1222, 1224 and 1226 which correspond to the cathode sub-pixel regions 1210, 1212 and 1214.

In FIG. 12F, when a positive voltage is applied to gate wire 1206 and a negative voltage is applied to gate wires 1204 and 1208, cathode half-pixel region 1216 emits electrons toward and illuminates anode half-pixel region 1228. Thus, as seen, using half pixel addressing, a region, e.g., anode half-pixel region 1228, of the phosphor line 1002 including a portion of anode sub-pixel region 1224 and a portion of anode sub-pixel region 1226 is illuminated. Thus, it appears as though a half-pixel in between two previously defined anode sub-pixel regions is illuminated. In other words, it appears as though a sub-pixel (or dot) is illuminated over gate wire 1206. Thus, FIG. 12F is a side view of the addressing and driving technique of FIG. 12C. Note that due to the electron emission curving slightly inward toward gate wire 1206, anode half-pixel region 1228 is slightly smaller than either anode sub-pixel region 1224 or 1226. Thus, anode half-pixel region 1228 is also slightly smaller than the corresponding cathode half-pixel region 1216. Again, this half pixel addressing allows for a pseudo resolution that is analog-like in performance. It is generally noted the FIGS. 12A–12F are not necessarily drawn to scale, but drawn to illustrate the various addressing and driving techniques.

To further illustrate the variable resolution aspect of the FED according to several embodiments of the invention, by simply following the addressing and driving techniques of FIGS. 12A, 12B and 12E, the FED has a first resolution generally based upon the number of cathode sub-pixel regions (e.g., cathode sub-pixel regions 1210, 1212 and 1214) in a single emitter line 406 by the number of emitter lines 406 across the cathode substrate. According to this first resolution, the number of cathode sub-pixel regions is fixed and dependent upon the spacing and frequency of the gate wires (e.g., gate wires 1202, 1204, 1206 and 1208). Likewise, the number of emitter lines 406 is generally fixed across the cathode substrate. Alternatively, this first resolution is based upon the number of anode sub-pixel regions (e.g., anode sub-pixel regions 1222, 1224 and 1226) within each phosphor line 1002 by the number of phosphor lines 1002 across the anode plate. Each of these anode sub-pixel regions corresponds to respective cathode sub-pixel regions. For example, the first resolution may be 1200×1200.

Advantageously, by using the addressing and driving techniques as shown in FIGS. 12A, 12B and 12E together with the addressing and driving techniques of FIGS. 12C, 12D and 12F, the FED defines a second resolution that appears greater than the first resolution. The second resolution is generally based upon the number of cathode sub-pixel regions (e.g., cathode sub-pixel regions 1210, 1212 and 1214) plus the number of cathode half-pixel regions (e.g., cathode half-pixel region 1216) in a single emitter line 406 by the number of emitter lines 406 across the cathode substrate. According to this second resolution, the number of cathode sub-pixel regions is fixed and dependent upon the spacing and frequency of the gate wires (e.g., gate wires 1202, 1204, 1206 and 1208); however, cathode half-pixel regions are created to appear as regions in between pairs of cathode sub-pixel regions. Each of these cathode half-pixel regions is directly underneath respective gate wires of the gate frame. Again, the number of emitter lines 406 is generally fixed across the cathode substrate. Alternatively, this second resolution is based upon the number of anode sub-pixel regions (e.g., anode sub-pixel regions 1222, 1224 and 1226) plus the number of anode half-pixel regions (e.g., anode half-pixel region 1228) within each phosphor line 1002 by the number of phosphor lines 1002 across the anode plate. Each of these anode half-pixel regions corresponds to respective cathode half-pixel regions. In other words, each anode half-pixel region appears to be a region (or dot) in between pairs of anode sub-pixel regions, i.e., appears as a dot directly over the gate wire. For example, the second resolution is a resolution appearing to be 1600×1200. As can be seen, the second resolution appears as if it illuminates more regions along the length of each phosphor line 1002 than the first resolution; thus, giving an enhanced resolution appearing better than an actual number of cathode and anode sub-pixel regions defined by the gate wires. Advantageously, an analog-like performance is created in an FED.

Figure 13A:
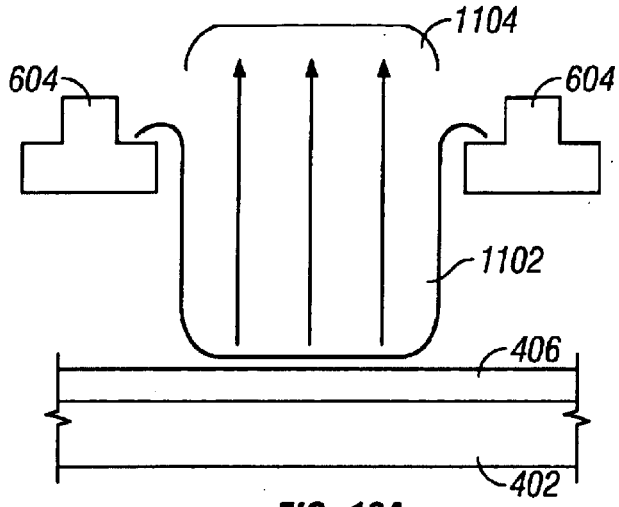
FIGS. 13A and 13B are diagrams illustrating an exemplary electric field produced by the FED of FIG. 11 and the electric field produced by the conventional FED of FIG. 1, respectively.
Figure 13B:
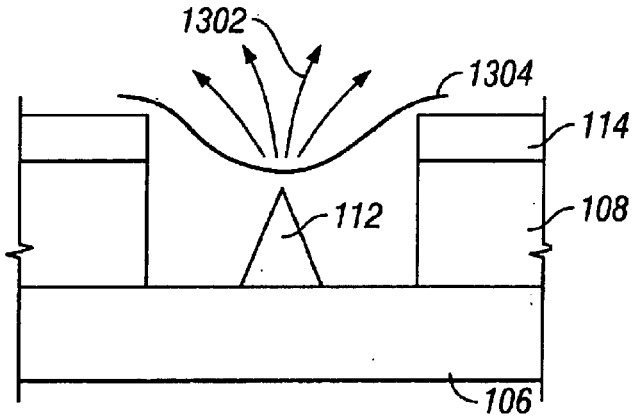
FIG. 13B (Prior Art)

Referring next to FIGS. 13A and 13B, diagrams are shown which illustrate an exemplary electric field produced by the field emission display of FIG. 11 and the electric field produced by a conventional field emission display, respectively. According to one embodiment of the invention shown in FIG. 13A, the electric field 1102 generated is such that the electron emission 1104 from the emitter line 406 of the cathode substrate 402 is substantially straight in the direction of the phosphor line of the anode. Thus, as illustrated, it is preferred that the electric field 1102 generated extends substantially uniformly above the portion of the emitter line 406 between adjacent gate wires 604 in order to uniformly pull electrons from the surface of the emitter line 406. This is in contrast to the electron emission 1302 shown in FIG. 13B of a conventional electron emitter 112 of the conventional FED 100 of FIG. 1, which generates an electric field 1304 that is designed to rip electrons from the tip of the conical electron emitter 112. Additionally, in preferred embodiments, the surface of the emitter line 406 should be a thin smooth layer in order to have as smooth and uniform electron emission as possible. This is again in contrast to the conventional FED, which uses small pointed electron emitters in which electrons are specifically ripped from the points.

Furthermore, by choosing the emitter material for the emitter lines carefully, the strength of the electric field 1102 should be significantly less than the strength of the electric field of the conventional FED in order to cause adequate electron emission. For example, according to one embodiment, the strength of the electric field 1102 is measured in terms of volts per distance (e.g., volts/$\mu$m) from the gate wire 604 to the surface of the emitter line 406. For example, using a carbon-based emitter material, the electric field strength for adequate electron emission is about 4 volts/$\mu$m. For example, if the gate wires 604 are 0.1 $\mu$m from the surface of the emitter line 406, then an electric field 1102 having a strength of 0.4 volts is sufficient, in comparison to a conventional FED which requires an electric field strength of about 100 volts/$\mu$m. It is noted that depending on the specific emitter material, the electric field strength necessary may be anywhere in between about 4 and 100 volts/$\mu$m. As is already described, in order to reduce the spread of electrons, a focusing electrode 204 is used in the conventional FED. In contrast, and according to one embodiment, the electron emission 1104 is optionally controlled using peripheral gate wires as described above. According to another embodiment of the invention, the actual cross sectional shape of the gate wire 604 itself may be controlled during manufacture in order to reduce the spread of electrons, e.g., to produce the desired substantially straight electron emission 1104 of FIG. 13A. It has been determined that the cross section of the gate wires 604 has an impact on the electric field 1102 produced, which affects the electron emission. This is further explored below.

Figure 14:
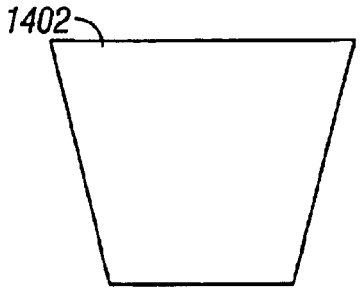
FIG. 14 (Prior Art)
FIG. 14 is a cross section of a conventional gate wire used within a conventional cathode ray tube (CRT) employing an aperture grill.
Figure 15:
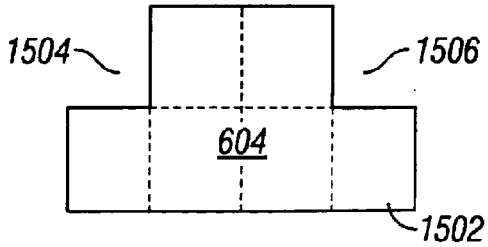
FIG. 15 is a cross section of a gate wire having a preferred cross sectional geometry according to one embodiment of the invention.

Referring next to FIG. 14, a cross section is shown of a conventional gate wire 1402 used within a conventional cathode ray tube (CRT) employing an aperture grill, such as found in Sony TRINITRON CRTs. Thus, the gate wire 1402 is formed to have an upside-down trapezoidal cross section. According to one embodiment of the invention, the cross section of the gate wire 604 is specifically manufactured such that the electric field during use will be substantially flat and uniform in between two respective gate wires. Thus, in contrast to the gate wire 1402, a preferred gate wire 604 as shown in FIG. 15 has a cross section generally having a rectangular cross section that is missing upper left and right quadrants. For example, the cross section of the gate wires of FIG. 15 resembles a rectangle including 8 quadrants 1502, 4 side by side in the top half and 4 side by side in the bottom half of the rectangle. The left and right upper quadrants are removed from the top half of the rectangle. These removed upper left and right quadrants may be referred to as notches 1504 and 1506 in the cross sectional profile of the gate wire 604. Gate wires having the desired cross sectional geometries can be manufactured using etching processes similar to those performed in creating aperture grills, electroplating, or any other technique to create a gate wire having the desired cross sectional shape. It is noted that the gate wire 604 may not exactly conform to this cross sectional shape, but it is preferred if the gate wire has a cross section substantially similar to that shown in FIG. 15. For example, one skilled in the art could vary the dimensions of the cross section in order to achieve slightly different results. By way of example, the dimensions of the notches 1504 and 1506 may be varied.

Figure 16:
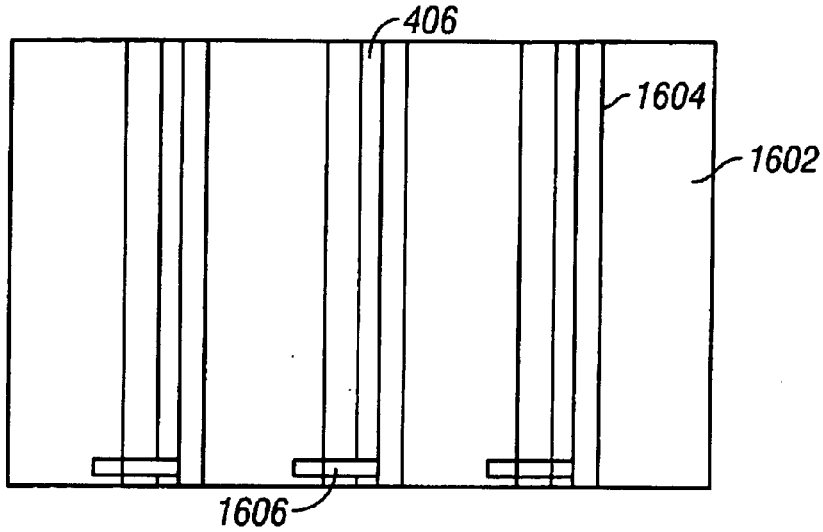
FIG. 16 is a top view of an alternative embodiment of the cathode plate in which the trenches of FIG. 5 are formed over the entire length of the cathode plate in order to simplify coupling respective emitter lines to a voltage source.
Figure 17:
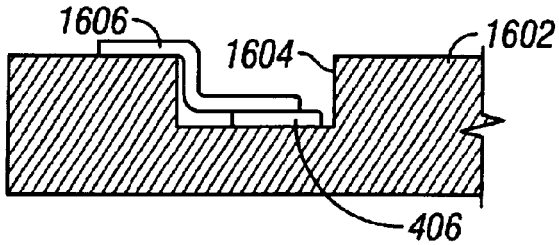
FIG. 17 is a cross section view illustrating the electrical connection of an emitter line formed within the trench of FIG. 17.

Referring next to FIG. 16, a top view is shown of an alternative embodiment of the cathode substrate 1602 in which trenches 1604 (similar to the trenches 504 of FIG. 5) are formed over the entire length of the cathode substrate 402 in order to simplify coupling respective emitter lines 406 to a voltage source. Since the trenches extend the full distance of the cathode substrate 402, an electrical connection 1606 may extend from a top surface of the cathode substrate 1602 into the trench 1604 and couple to the end of the emitter line 406. A side cross-sectional view of this embodiment is illustrated in FIG. 17. The electrical connection couples to a respective trace or other contact of the cathode plate 1602 and is bent into the trench 1604 and is coupled to the emitter line 406 in order to apply the proper driving voltages to the emitter line 406 in accordance with the driving and addressing software.

Figure 18:
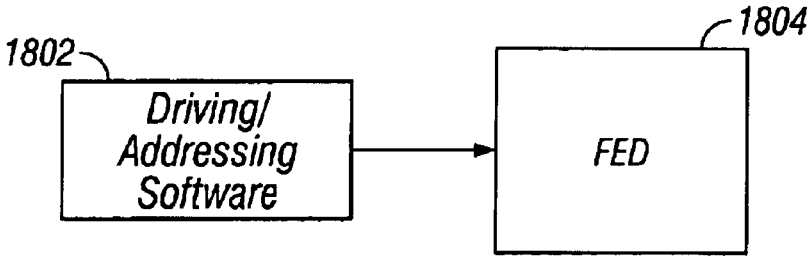
FIG. 18 is a block diagram illustrating the addressing software that addresses and drives the emitter lines and gate wires of the FED devices of several embodiments of the invention.

Referring next to FIG. 18, a block diagram is shown of the software that addresses and drives the emitter lines and gate wires of the FED devices of several embodiments of the invention. The driving/addressing software 1802 represents a set of instructions executable upon a processor or other programmable device. The driving addressing software 1802 is coupled to the FED 1804 components in order to effectively operate the FED 1804. The driving/addressing software is similar to and employs half-pixel addressing similar to TRINITRON CRTS available from Sony Electronics Inc. One of ordinary skill in the art could configure the driving/addressing software to accomplish the various driving and addressing techniques described herein.

While the invention herein disclosed has been described by means of specific embodiments and applications thereof, numerous modifications and variations could be made thereto by those skilled in the art without departing from the scope of the invention set forth in the claims.

What is claimed is:

1. A cathode plate of a field emission display comprising:

a cathode substrate of the field emission display; and a plurality of emitter lines formed on the cathode substrate;

each emitter line having electron emitting material continuously extending across multiple, separately addressable regions of the cathode substrate, each region adapted to emit electrons therefrom;

wherein there is no separating structure positioned in between portions of the electron emitting material forming an emitter line on the surface of the cathode substrate.

2. The cathode plate of claim 1 further comprising a plurality of linear isolation barriers attached to the cathode substrate, wherein the plurality of linear isolation barriers separate a respective one or more of the plurality of emitter lines from others of the plurality of emitter lines.

3. The field emission display of claim 2 wherein the linear isolation barriers are adapted to contact a plurality of gate wires of a gate frame and dampen vibrations from a driving frequency.

4. The cathode plate of claim 2 wherein each one of the plurality of emitter lines is positioned between a respective two of the plurality of linear isolation barriers.

5. The cathode plate of claim 2 wherein the plurality of linear isolation barriers comprise a plurality of ribs.

6. The cathode plate of claim 1 further comprising a plurality of in-laid isolation barriers formed with a depth of a top surface of the cathode substrate, wherein each one or more of the plurality of emitter lines is formed within a respective one of the plurality of in-laid isolation barriers.

7. The cathode plate of claim 6 wherein portions of the top surface of the cathode substrate in between respective ones of the plurality of in-laid linear isolation barriers are adapted to contact a plurality of gate wires of a gate frame and dampen vibrations from a driving frequency.

8. The cathode plate of claim 6 wherein each one of the plurality of emitter lines is positioned within the respective one of the plurality of in-laid isolation barriers.

9. The cathode plate of claim 6 wherein the plurality of in-laid isolation barriers comprises a plurality of trenches.

10. The cathode plate of claim 1 further comprising an alignment barrier attached to the cathode substrate for positionally aligning other components of the field emission display on the cathode substrate.

11. The cathode plate of claim 1 wherein the plurality of emitter lines each comprise a substantially smooth layer of the electron emitting material formed on the cathode substrate.

12. The cathode plate of claim 1 wherein the electron emitting material of each of the plurality of emitter lines comprises a plurality of conical emitters deposited closely together in a linear fashion on the cathode substrate.

13. The cathode plate of claim 1 wherein the electron emitting material of each of the plurality of emitter lines comprises a plurality of emitter portions deposited on a surface of the cathode substrate, wherein there is no separating structure positioned in between adjacent emitter portions on the surface of the cathode substrate.

14. The cathode plate of claim 1 wherein the electron emitting material of each of the plurality of emitter lines comprises a continuous line of deposited emitter material extending across the cathode substrate.

* * * * *